US005337034A

United States Patent [19]

Grimes

[11] Patent Number: 5,337,034

[45] Date of Patent: Aug. 9, 1994

[54] TRANSFORMER MOUNTING ASSEMBLY

[75] Inventor: Frank H. Grimes, Athens, Ga.

[73] Assignee: ABB Power T & D Company Inc., Pa.

[21] Appl. No.: 41,757

[22] Filed: Apr. 2, 1993

[51] Int. Cl.[5] ..... H01F 27/06; H01F 27/26

[52] U.S. Cl. ..... 336/92; 248/300; 248/500

[58] Field of Search ..... 248/300, 500, 220.2, 248/223.3; 336/92, 210

[56] References Cited

U.S. PATENT DOCUMENTS

| | | | |
|---|---|---|---|
| 2,458,897 | 1/1949 | DeSwart | 248/223.3 |
| 2,528,358 | 10/1950 | Grass | 248/223.3 |
| 2,790,616 | 4/1957 | Cardinal, Jr. | 248/223.3 |
| 3,219,958 | 11/1965 | McKee | 336/92 |
| 4,839,622 | 6/1989 | Hay | 336/92 |
| 4,890,086 | 12/1989 | Hill | 336/92 |

*Primary Examiner*—Thomas J. Kozma

*Attorney, Agent, or Firm*—Ostrolenk, Faber, Gerb & Soffen

[57] ABSTRACT

An assembly for mounting a transformer in a tank, comprising a top and bottom frame, the transformer being located between the top and bottom frames. A plurality of slots are disposed in a row in the top frame. L-shaped brackets are provided for securing the transformer to the tank. The brackets include a toggled end disposed on one end and a shear lug located interior of the toggled end. The toggled end and the shear lug are each disposed in one of the plurality of slots to secure the transformer with the tank. The plurality of slots allow relocation of the brackets along the top frame. A bore is also disposed in the L-shaped bracket. A mounting screw extends through the bore and through one of the plurality of slots in the top frame to further secure the top frame to the tank, the mounting screw maintaining electrical continuity between the top frame and the tank. The shear lug bears any lateral forces which would be otherwise received by the ground screw.

10 Claims, 3 Drawing Sheets

TRANSFORMER MOUNTING ASSEMBLY

BACKGROUND OF THE INVENTION

1. Field of the Invention

The present Invention relates to a mounting assembly for mounting a transformer in a tank, and more particularly to a mounting assembly using a minimum number of parts for a large range of transformer sizes, and which provides stress relief.

2. Description of the Prior Art

It has been known to mount a transformer on a mounting plate which is in turn secured to a wall of the transformer tank. U.S. Pat. No. 4,631,509 discloses an upper mounting plate upon which an electrical induction apparatus is mounted. The mounting plate is then secured to the inner wall of a casing. Likewise, U.S. Pat. Nos. 3,883,206, and 4,260,975 disclose mounting a transformer core and coil assembly onto the interior of a tank.

These types of mounting assemblies use mounting plates which are permanently affixed to the transformers and the brackets or other mounting means are permanently affixed to the inner tank walls. Because the transformers are ordinarily affixed to the mounting plates only in the center, the coupling of the mounting plate and the transformer is unstable in the presence of lateral forces.

Moreover, since the brackets are permanently affixed to the tank, normally only a single size mounting frame can be used within a particular size or style of tank.

Also, the known mounting arrangements require a plurality of different parts, leading to increased mounting time and higher manufacturing expenses.

SUMMARY OF THE INVENTION

It is an object of the present invention to provide an assembly for mounting a transformer in a tank wherein lateral stresses between the transformer and the tank is eliminated.

Another object of the present invention is to provide a transformer mounting assembly which is adjustable to fit in tanks having different sizes and styles.

Still a further object of the present invention is to provide a transformer mounting assembly which requires a limited number of parts, thus decreasing manufacturing and assembly costs.

In accordance with the above objects, the present invention comprises an assembly for mounting a transformer in a tank having a top and bottom frame. The transformer is located between the top and bottom frames. Securing brackets are provided for securing the top frame to the tank. The brackets include a toggled end and a shear lug located interior of the toggled end. A row of a plurality of slots are disposed along the top frame. The toggled end and the shear lug are fit into spaced respective ones of the plurality of slots in the top frame to secure the transformer with the tank, the plurality of slots allowing relocation of the securing means along the top frame.

Preferably, the mounting assembly further comprises a bore disposed in the brackets. A mounting screw extends through the bore and through one of the plurality of slots in the top frame to further secure the brackets to the top frame, while also maintaining electrical continuity between the top frame and the tank. The shear lug bears any lateral forces which would be otherwise received by the ground screw.

Other features and advantages of the present invention will become apparent from the following description of the invention which refers to the accompanying drawings.

DETAILED DESCRIPTION OF THE PREFERRED EMBODIMENT

Figure 1:
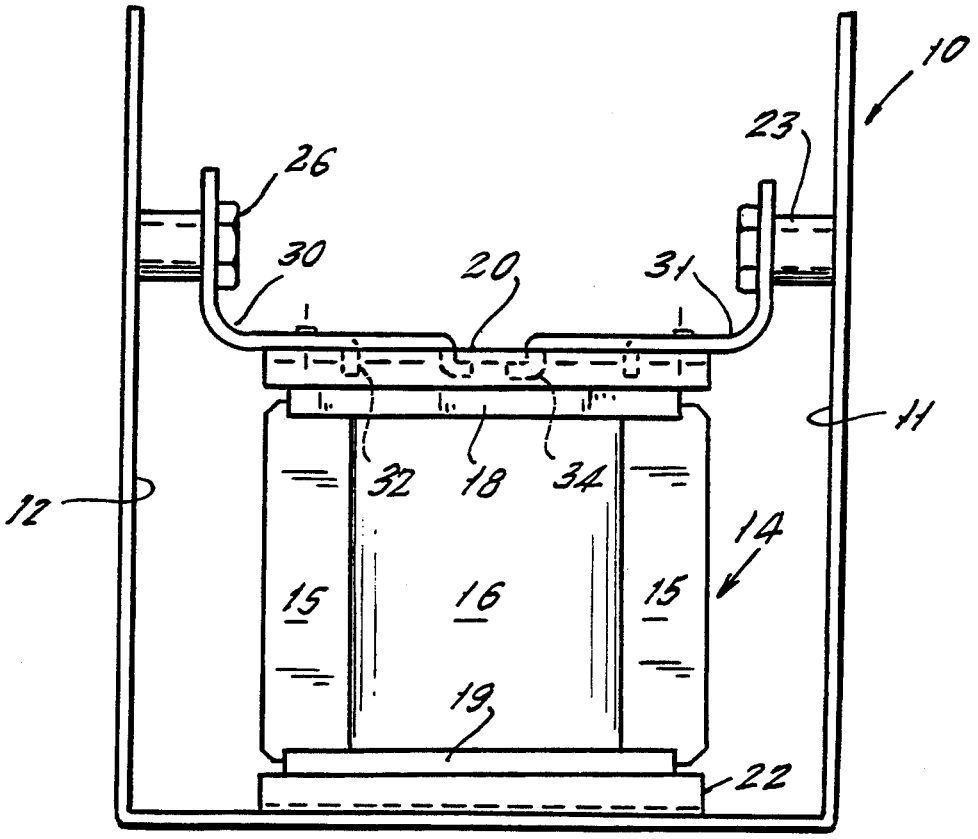
FIG. 1 is a side cross-sectional view of the mounting assembly of the present invention.

Referring to FIG. 1, the transformer 14 comprises a core 15 and coil 16 mounted within tank 10. The tank 10 has sidewalls 11, 12 upon which the transformer is mounted. The present invention provides a mounting assembly which can be used for mounting transformers having numerous core widths in a variety of different sized and styled enclosures.

The transformer 14 is provided with first and second pressure plates 18, 19 for securing the transformer to top and bottom frames 20 and 22, respectively (see FIGS. 1 and 2), which may be made of a suitable sheet metal. Thus, the first pressure plate 18 is attached to the top of transformer 14 and the second pressure plate 19 is attached to the bottom of transformer 14. The first and second pressure plates 18 and 19 respectively, are connected to top and bottom frames 20 and 22 by any suitable means, for example, welding. The bottom frame 22 rests against the bottom of tank 10. However, the frame 22 could also be spaced from the tank bottom, if desired. The top frame 20 is firmly attached to a pair of L-shaped brackets 30, 31, which will be described herein. The transformer and pressure plates are firmly clamped with the top and bottom frames by a pair of bands 27 (see FIG. 2).

A plurality of slots 42, 44 (FIG. 5) are disposed along top frame 20. The plurality of slots 42, 44 allow L-shaped brackets 30, 31 to be relocated along the top frame to adjust the mounting assembly for different sized and styled tanks, by moving the brackets inward or outward along the length of the top frame (see FIG. 3). For example, the top frame and bracket assembly of the present invention can be accommodated in tanks having standard diameters of $13\frac{1}{4}$, $15\frac{1}{4}$ and $17\frac{1}{2}$ inches.

Figure 2:
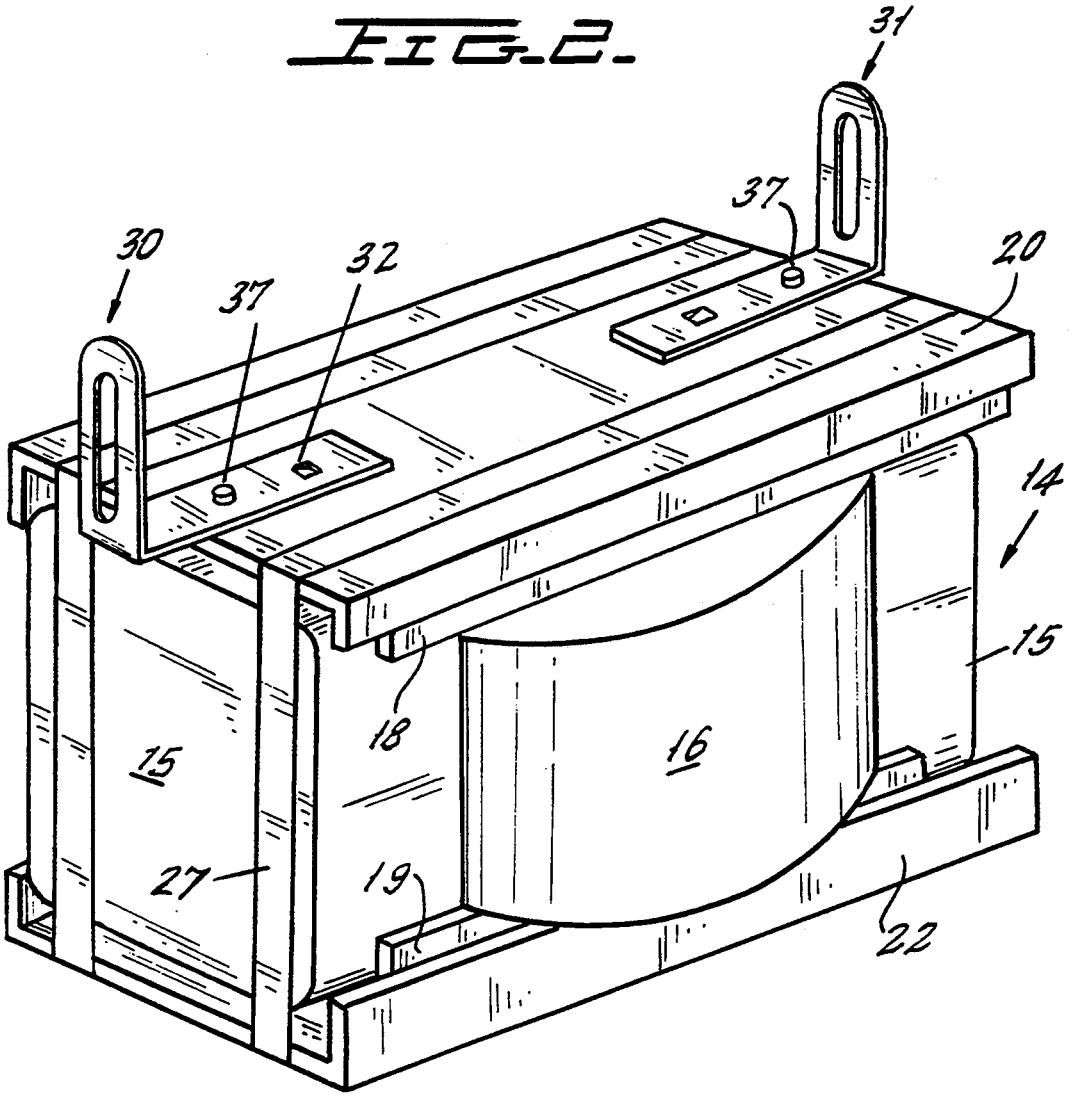
FIG. 2 is a perspective view of the transformer and mounting assembly.

As shown in FIG. 2, the first L-shaped bracket 30 is secured to one end of the top frame and the second L-shaped bracket 31 is secured on the other end. The L-shaped brackets 30, 31 secure top frame 20 to the inner walls 11, 12 of tank 10, as shown in FIG. 1.

Figure 3:
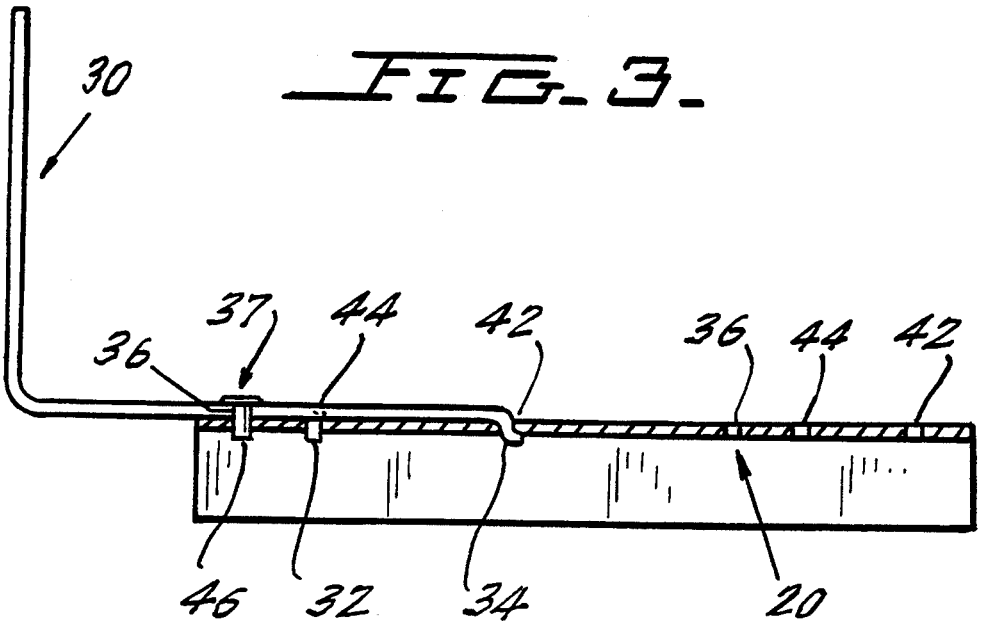
FIG. 3 is a cross-sectional view of the bracket and top frame of the present invention.
Figure 4:
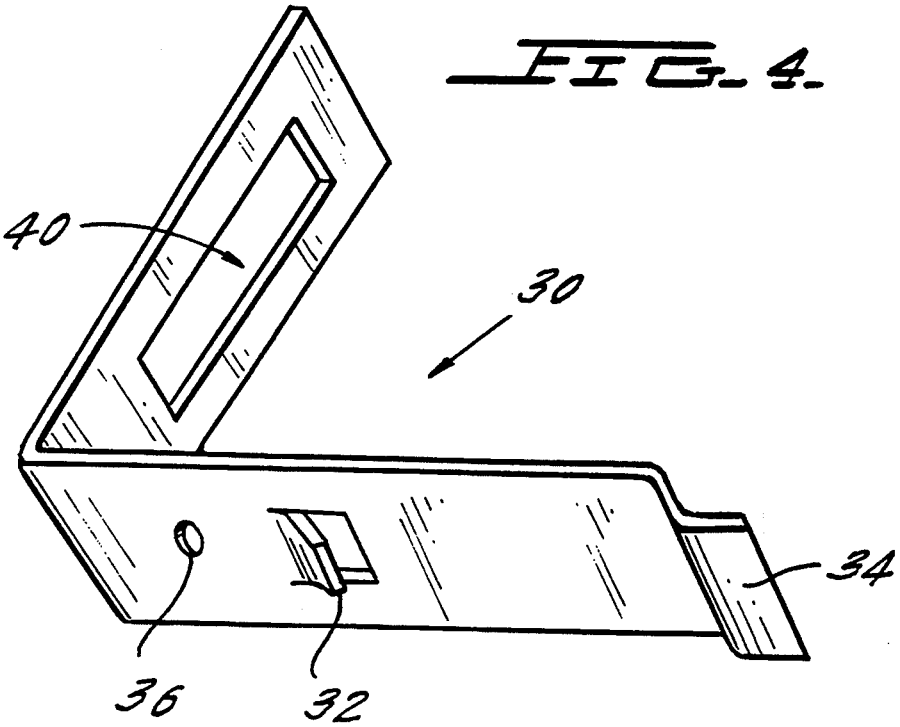
FIG. 4 is a perspective view of the bracket of the present invention.

The L-shaped bracket 30, as shown in FIG. 4, has opposed ends and includes a toggled end 34 (FIG. 3) disposed on one end and a shear lug 32 located interior of the toggled end 34. Shear lug 32 is in the form of a tongue or tab, cut out from the bracket and extended downward. The shear lug restricts the movement of the top frame relative to the bracket in a transverse direction. Shear lug 32, when fixed to the top frame, forms a connection which withstands lateral forces which otherwise would be received by the ground screw 37, described herein.

The L-shaped brackets 30, 31 are bent upwardly at a right angle at the other end to engage inner walls 11, 12 of tank 10. The upwardly bent end of the bracket includes a vertical slot 40. As depicted in FIG. 1, the inner walls 11, 12 of the tank include a pad 23. The vertical slot 40 of each of the L-shaped brackets is aligned with the respective pads 23. A self-locking screw 26 extends through slot 40 into the pad to secure the brackets and top frame to the tank.

As shown in FIGS. 3 and 4, a bore 36 is disposed in each of the brackets between shear lug 32 and the upwardly bent end. A ground screw 37 extends through bore 36 into the top frame, which will be described herein. The ground screw 37 maintains electrical continuity between the transformer and top frame 20 even in the presence of undesired lateral forces.

Next the assembly of the brackets and the top frame will be described, with reference to FIGS. 1 and 3. As shown in FIG. 3, the toggled end 34 of bracket 30 extends downward and is capable of being locked within a slot 42 disposed in the top frame 20. Shear lug 32 extends downward through a slot 44 in the top frame. Ground screw 37 extends through bore 36 in the bracket and through a slot 46 in the top frame. The ground screw 37, shear lug 34 and toggled end 34 act together with the top frame to secure the transformer to the tank. It should be appreciated that the top and bottom frames are interchangeable, if desired.

Figure 5:
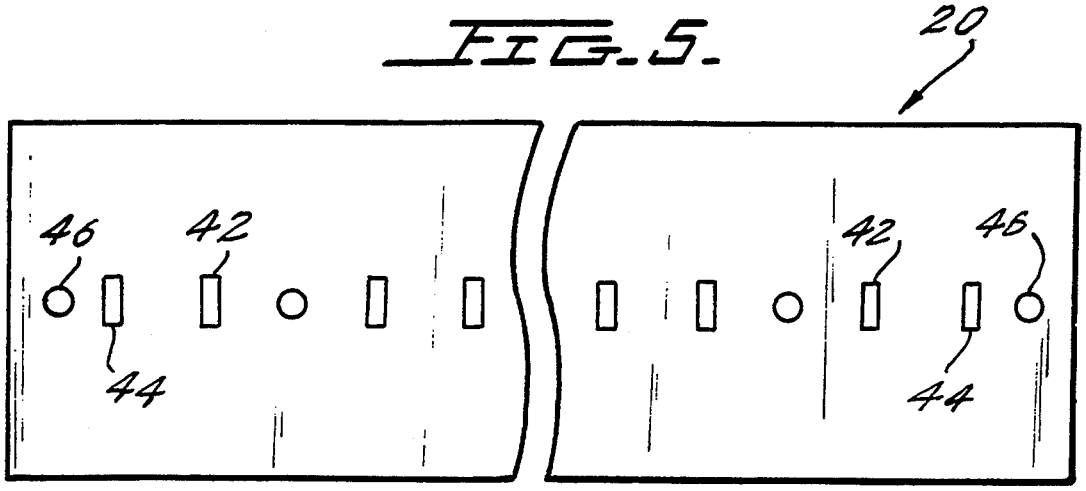
FIG. 5 is a top view of the top frame of the present invention.

A plurality of slots, shown in FIG. 5, having the spacings of slots 42, 44 and 46 are disposed along the axially length of top frame 20. As previously mentioned the plurality of slots allow relocation of the pair of L-shaped brackets along the top frame, so that different sized and styled tanks can be used.

Although the present invention has been described in relation to an assembly for mounting a transformer in a tank, the invention is not limited to transformers, and can be used for mounting any type of apparatus.

Many variations, modifications and other uses of the invention will become apparent to those skilled in the art. It is preferred, therefore, that the present invention be limited not by the specific disclosure herein, but only by the appended claims.

What is claimed is:

1. An assembly mounting a transformer in a tank, comprising:

a top frame secured to the top of said transformer;

a row of a plurality of slots disposed in said top frame; and first and second securing means for securing said top frame to respective ones of opposite interior walls of said tank, each of said securing means having a first portion connectable to a wall of said tank, and a second portion having a toggled end and a shear lug located interior of said toggled end, said toggled end of each of said securing means being disposed through a selected one of said respective plurality of slots in said top frame and under the top frame adjacent said selected one of said slots to secure the transformer to the tank, said shear lug of each of said securing means being slipped into a respective one of said slots of said frame which are spaced from said slots receiving said toggled ends, said plurality of slots allowing placement of said securing means along said top frame, in accordance with the size of said transformer.

2. The assembly of claim 1, further comprising a bore adapted to receive a grounding screw disposed in each of said securing means.

3. The assembly of claim 2, further comprising a mounting screw extending through said bore and through one of said plurality of slots in said top frame to further secure each of said securing means to said top frame, wherein said mounting screw maintains electrical continuity between said top frame and said tank, and said shear lug bears any lateral forces which would be otherwise received by said grounding screw.

4. The assembly of claim 1, wherein said first and second securing means comprises a pair of L-shaped brackets disposed on opposed ends of said top frame.

5. The assembly of claim 1, wherein the other end of each of said securing means is bent upwardly at a right angle to engage and be fixed to an inner wall of the tank.

6. The assembly of claim 5, wherein said upwardly bent end of each of said securing means includes a vertical slot for adjustment of the vertical position of said transformer.

7. The assembly of claim 6, wherein said interior walls of the tank include pads, and said vertical slots of each of said securing means align with respective ones of said pads.

8. The assembly of claim 7, further comprising a self-locking screw extending through each of said vertical slots into the respective pad to secure said top frame to the tank.

9. The assembly of claim 1, further comprising first and second pressure plates, said first pressure plate being attached to the top of said transformer and said top frame and said second pressure plate being attached to the bottom of said transformer.

10. The assembly of claim 1, wherein said first and second securing means comprises a respective first and a second bracket, said first bracket being secured to one end of said top frame and said second bracket being secured on the other end.

* * * * *